US010753616B2

(12) United States Patent
Wu et al.

(10) Patent No.: US 10,753,616 B2
(45) Date of Patent: Aug. 25, 2020

(54) BIOMASS PELLET STOVE

(71) Applicant: Qingdao Genjoy Home Fashion Co., Ltd., Qingdao, Shandong (CN)

(72) Inventors: Xiaohui Wu, Shandong (CN); Fangwen Cai, Shandong (CN)

(73) Assignee: Qingdao Genjoy Home Fashion Co., Ltd., Qingdao, Shandong (CN)

( * ) Notice: Subject to any disclaimer, the term of this patent is extended or adjusted under 35 U.S.C. 154(b) by 935 days.

(21) Appl. No.: 15/151,725

(22) Filed: May 11, 2016

(65) Prior Publication Data

US 2016/0334107 A1 Nov. 17, 2016

(30) Foreign Application Priority Data

May 12, 2015 (CN) ..... 2015 2 0302164 U

(51) Int. Cl.
*F24B 13/04* (2006.01)
*F23B 50/12* (2006.01)
*F24B 1/02* (2006.01)

(52) U.S. Cl.
CPC ..... *F24B 13/04* (2013.01); *F23B 50/12* (2013.01); *F24B 1/024* (2013.01)

(58) Field of Classification Search
CPC .. F24B 13/04; F23B 50/12; F23K 3/16; F23K 3/00; F23G 2205/14; F23G 2205/16; F23G 5/245
USPC ..... 126/73, 7, 501; 110/293, 101 R, 116, 110/118
See application file for complete search history.

(56) References Cited

U.S. PATENT DOCUMENTS 2,898,839 A * 8/1959 McKann ..... E04D 13/1476 126/307 R
3,522,767 A * 8/1970 Derringer ..... F23J 11/00 110/184
4,442,825 A * 4/1984 Waldau ..... F23B 50/00 110/101 CC
4,606,282 A * 8/1986 Steindal ..... F23B 1/16 110/116
5,133,266 A * 7/1992 Cullen ..... F23B 1/00 110/110
5,144,939 A * 9/1992 Christopherson ..... A01G 13/06 110/108
5,183,028 A * 2/1993 Traeger ..... F24B 1/024 110/102
5,251,607 A * 10/1993 Traeger ..... A47J 37/0704 126/108
5,295,474 A * 3/1994 Whitfield ..... F23B 1/00 110/293

(Continued)

FOREIGN PATENT DOCUMENTS

DE 710911 C * 9/1941 ..... A21B 1/02
EP 2602551 A1 * 6/2013 ..... F23B 50/12

*Primary Examiner* — David J Laux
(74) *Attorney, Agent, or Firm* — Young Basile Hanlon & MacFarlane, P.C.

(57) ABSTRACT

A stove using biomass pellets as fuels is disclosed herein, comprising a stove body that comprises a firebox, at least one hopper, and a feed tube, wherein the at least one hopper is connected to the firebox via the feed tube, and fuels contained inside the at least one hopper can enter the firebox along the feed tube under gravity. The stove has a simple structure and removes any mechanically or electrically controlled feeding system by feeding the firebox using gravity of the fuels, therefore lowers the cost.

18 Claims, 6 Drawing Sheets

Section A-A

(56) References Cited

U.S. PATENT DOCUMENTS 5,357,877 A * 10/1994 Nuesmeyer ..... F23B 50/12 110/108
5,383,446 A * 1/1995 Whitfield ..... F23B 1/00 110/110
5,429,110 A * 7/1995 Burke ..... A47J 37/0704 110/110
5,462,046 A * 10/1995 Hannah ..... F24B 1/199 110/101 C
5,873,356 A * 2/1999 Vossler ..... F23B 1/38 110/203
D835,246 S * 12/2018 Zhang ..... D23/329
2002/0083944 A1* 7/2002 Darbonne, Sr. ..... F23B 1/38 126/501
2006/0272557 A1* 12/2006 Liu ..... F23B 50/12 110/101 R
2007/0157858 A1* 7/2007 Gagner ..... F23B 30/10 110/102
2007/0186920 A1* 8/2007 Wisener ..... F23B 1/38 126/77
2009/0038603 A1* 2/2009 Hepper ..... F24B 1/024 126/73
2010/0251973 A1* 10/2010 Dongo ..... F23B 40/08 122/14.1
2010/0300428 A1* 12/2010 Bald ..... F24B 1/08 126/501
2013/0104873 A1* 5/2013 Henry ..... F24H 3/067 126/107
2014/0238282 A1* 8/2014 Zhu ..... F24B 1/181 110/241
2016/0161127 A1* 6/2016 Hill ..... F24B 13/04 126/73
2016/0377297 A1* 12/2016 Shin ..... F24B 1/189 126/68
2017/0082292 A1* 3/2017 Amlin ..... F24B 13/008
2017/0328572 A1* 11/2017 Wu ..... F24B 13/04
2018/0142886 A1* 5/2018 Huddleston ..... F23B 50/06

* cited by examiner

Section A-A

Section A-A

BIOMASS PELLET STOVE

CROSS-REFERENCE TO RELATED APPLICATIONS

This application claims priority to Chinese patent application no. 201520302164.X, by Qingdao Genjoy Home Fashion Co., Ltd., filed on May 12, 2015, the disclosure of which is herein incorporated by reference in its entirety.

TECHNICAL FIELD

The present disclosure relates to the technical field of pellet stove, and particularly to a pellet stove that uses biomass pellets as fuels.

BACKGROUND

Pellet stoves that use biomass pellets as fuels can have a large size and heavy weight, inconvenient for mobile use after installing, usually suitable for indoor use of heating. In addition, they often have complex designs and high manufacturing cost, and may include many electrical components, such as an auger system or other feeding apparatuses to feed biomass pellets to a firebox, which limit reliability and raise costs of use and maintenance.

For activities such as outdoor travelling, camping, hiking, leisure activities, but when in a low temperature, people often resort to relatively primitive means, such as campfire or a fire pit with burning woods, for heating and warming.

SUMMARY

This disclosure provides stove using biomass pellets as fuels as a solution to a technical problem.

According to aspects of this disclosure, the stove using biomass pellets as fuels comprises a firebox, at least one hopper, and a feed tube, wherein the at least one hopper is connected to the firebox via the feed tube, and fuels contained inside the at least one hopper enter the firebox along the feed tube under gravity.

More details of the stove are set forth in the following description.

BRIEF DESCRIPTION OF THE DRAWINGS

The technical solution of the present disclosure or the related art will be more clearly understood from the following detailed description taken in conjunction with the accompanying drawings; it will be apparent to one of ordinary skill in the art that the accompanying drawings described below are merely implementations of the disclosure and other drawings can be obtained out of them, in which:

In FIGS. 1-3: 1—stove body, 2—firebox, 3—hopper, 4—feed tube, 4.1—upright tube, 4.2—slant tube, 5—grate, 6—grate support ring, 7—grate lever, 8—ash tray, 9—handle, 10—stove body door, 11—viewport, 12—hopper cover, 13—interlayer I, 14—interlayer II, 15—vent I, 16—vent II, 17—vent III, 18—air intake pipe, 19—leg, 20—chimney, 21—vent IV, 22—chimney cap (heat reflector), 23—vent V, 24—baking area, 25—vent VI, 26—casing, 27—exhaust, 28—control lever, 29—ring.

DETAILED DESCRIPTION

Figure 1:
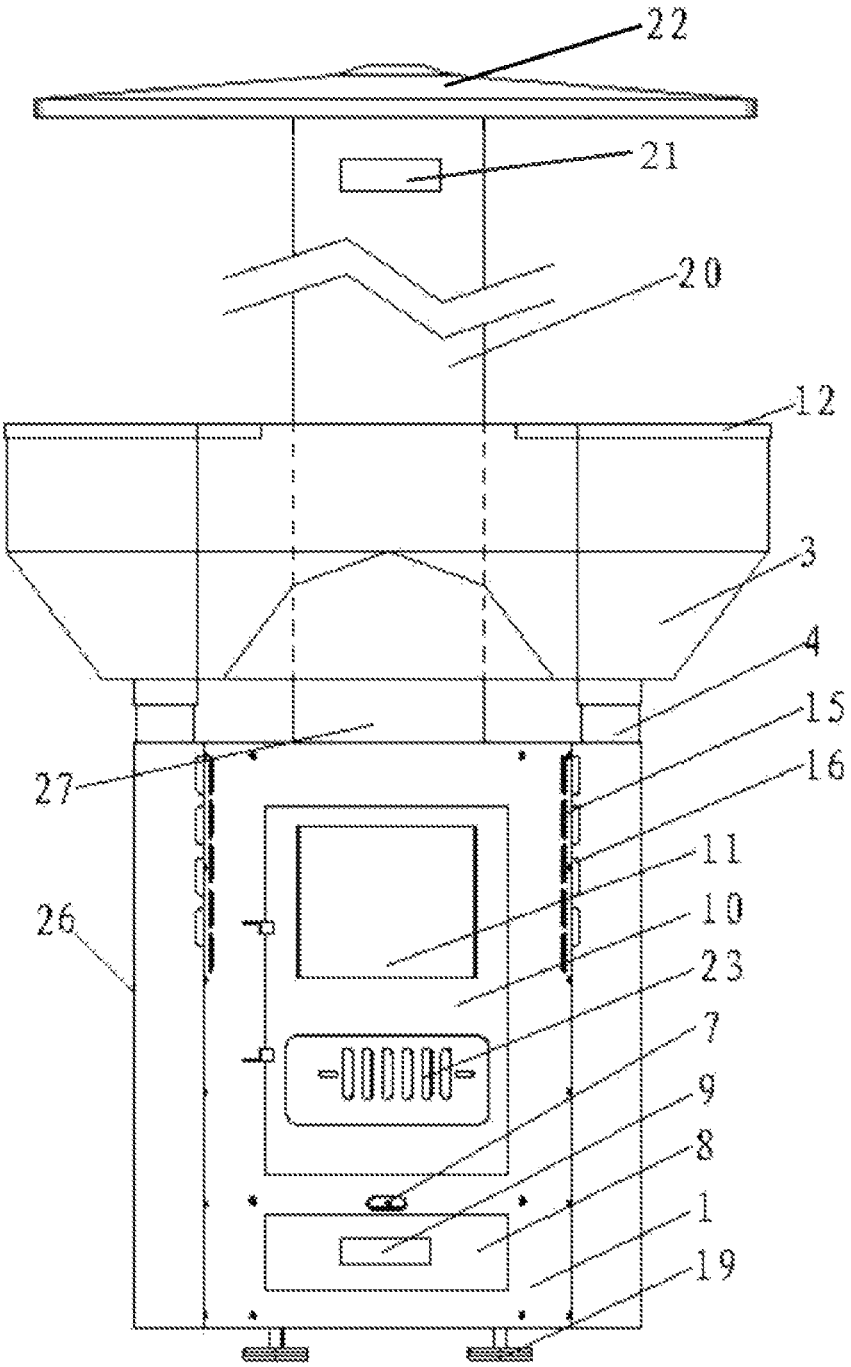
FIG. 1 is a diagram of a schematic of an example biomass pellet stove according to an implementation of this disclosure.
Figure 2:
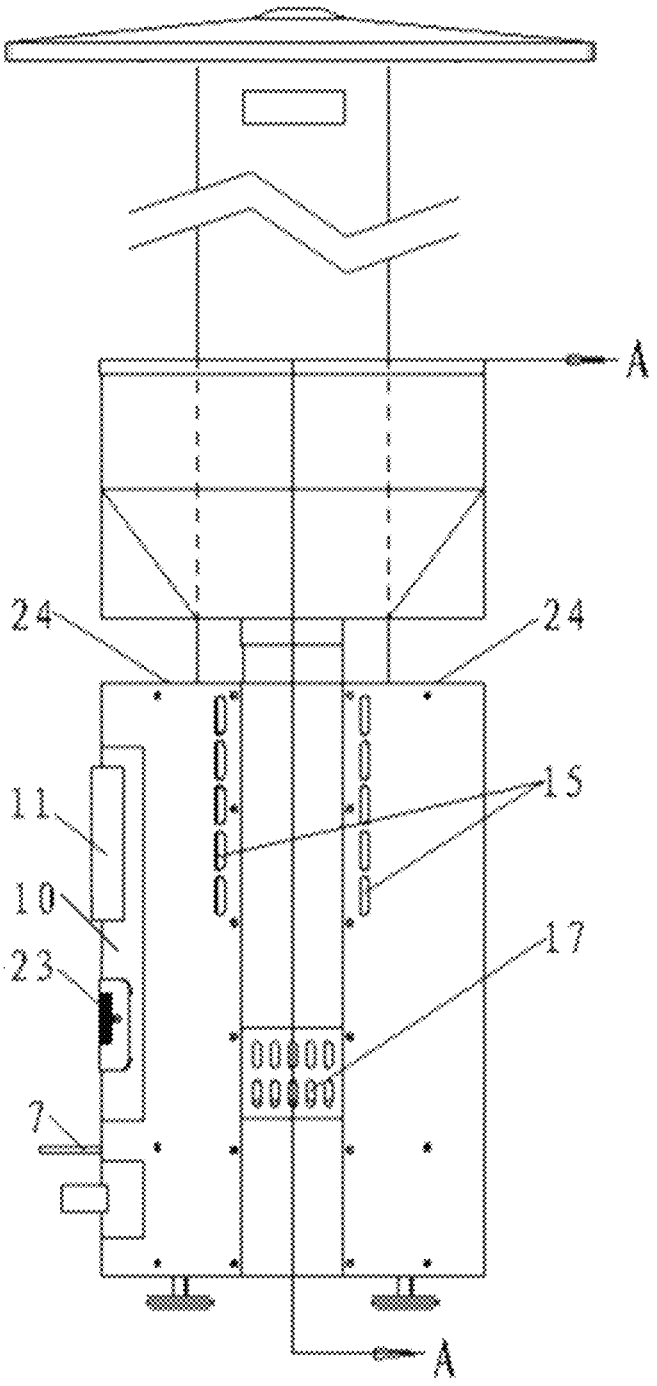
FIG. 2 is a diagram of a schematic of an example biomass pellet stove according to an implementation of this disclosure.
Figure 3:
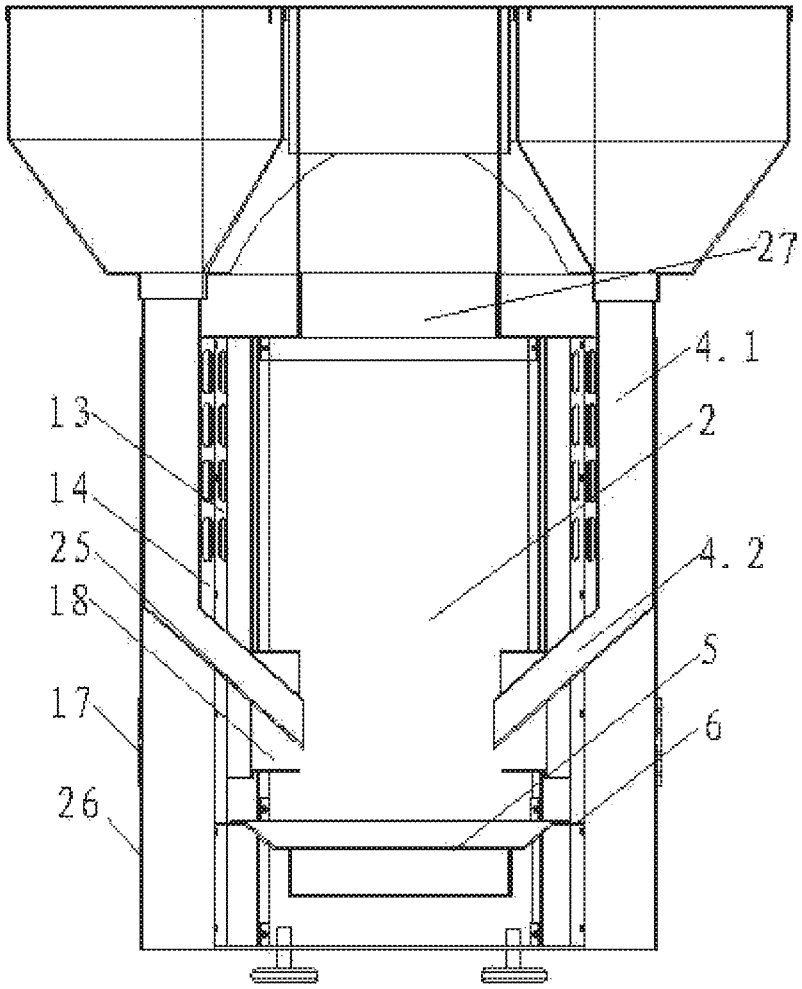
FIG. 3 is a section A-A of FIG. 2.
Figure 4A:
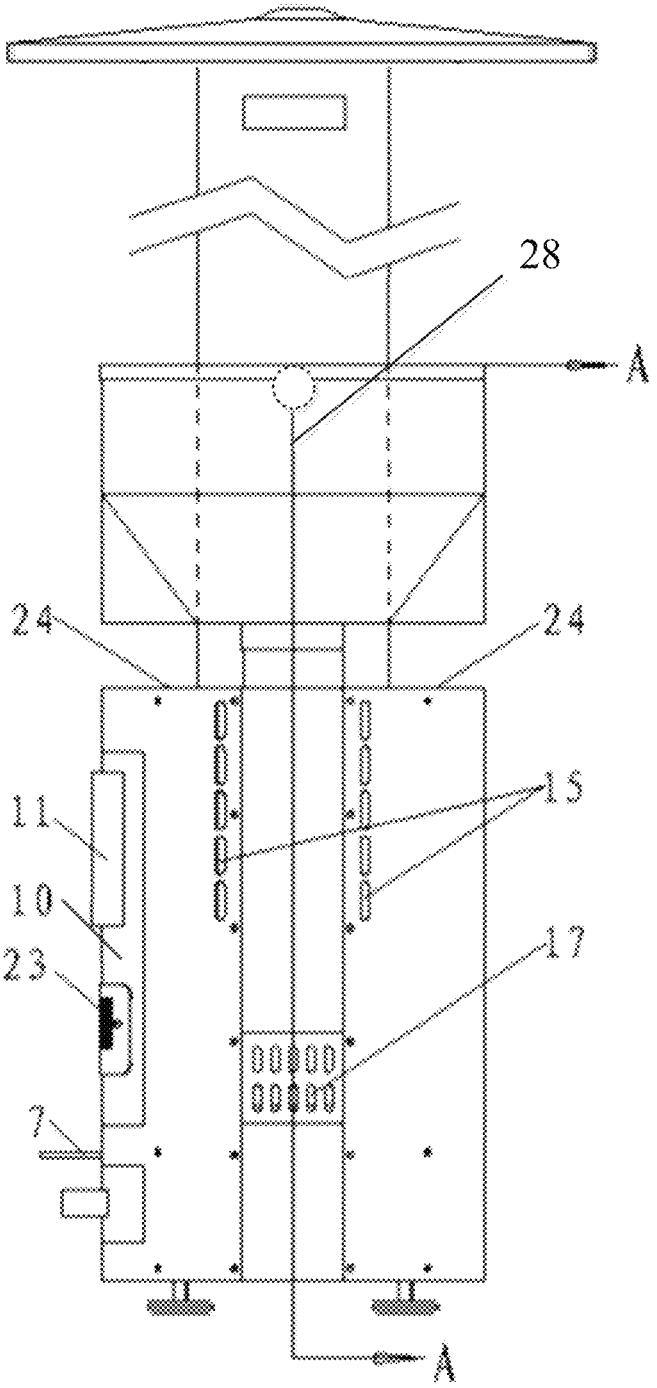
FIG. 4A is a diagram of another example biomass pellet stove with a control lever according to an implementation of this disclosure.
Figure 4B:
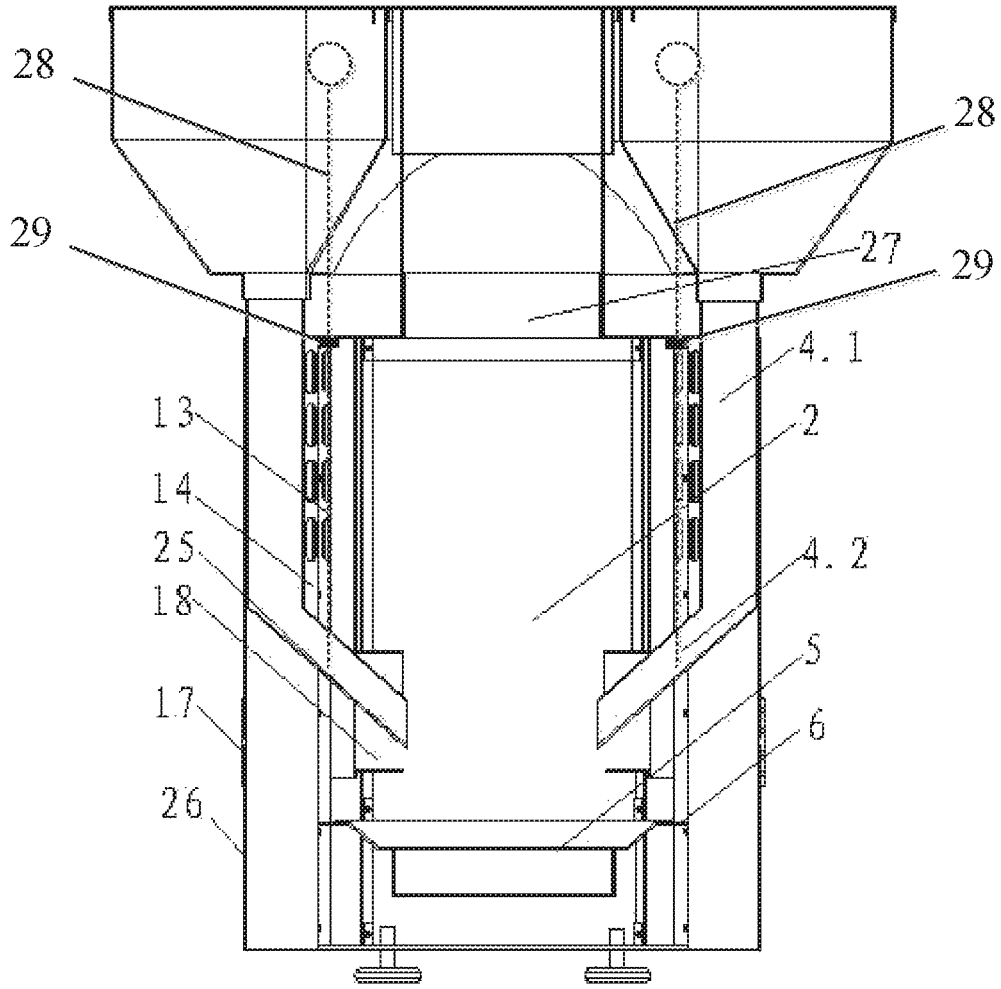
FIG. 4B is a section A-A of FIG. 4A.
Figure 5:
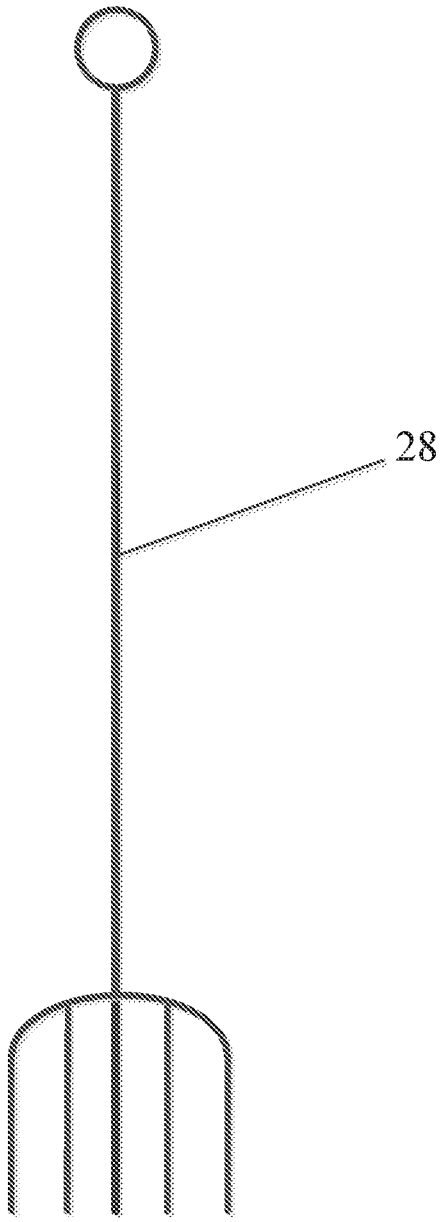
FIG. 5 is an example control lever.

The foregoing descriptions are merely preferred embodiments or implementations rather than limitations of the present disclosure. Various modifications and alterations can be made to the present disclosure for those skilled in the art. Any modification, equivalent substitution, improvement or the like made within the spirit and principle of the present disclosure shall fall into the protection scope of the present disclosure.

A stove using biomass pellets as fuels is disclosed herein, wherein the stove can include stove body 1 inside which a firebox 2 resides, and two hoppers 3 installed symmetrically, each connecting to firebox 2 via one of two symmetrically disposed feed tubes 4, and wherein fuels contained in the hoppers 3 can enter firebox 2 via feed tubes 4 under gravity. The stove has a simple structure and removes any mechanically or electrically controlled feeding system by feeding firebox 2 using gravity of the fuels, therefore lowers the cost. The stove also has two hoppers 3 for increasing storage capacity of fuels, which can effectively increases the combustion time, and the hoppers 3 are installed symmetrically so that the fuels can be fed into firebox 2 from both sides evenly, which can make the combustion more stable and balanced.

Hoppers 3 are arranged at an upper portion of stove body 1, with each hopper having a gap between stove body 1 and a hopper cover 12 disposed above. The gaps between hoppers 3 and stove body 1 can serve as an air insulation to avoid overheat of the hoppers, which effectively controls temperature of the fuels contained in the hoppers, therefore improves safety as well as provides means to bake foods above stove body 1. Hopper covers 12 can restrain excessive air from entering hoppers 3, therefore preventing the fuels contained in hoppers 3 burn therein.

Each of the feed tubes 4 can include an upright tube 4.1 and a slant tube 4.2, in which upright tube 4.1 can join hopper 3 with a first end portion and join a third end portion of slant tube 4.2 with a second end portion, and slant tube 4.2 can connect to firebox 2 with a fourth end portion. The upright tube 4.1 and the slant tube 4.2 can utilize gravity to feed the fuels to firebox 2.

On each side of stove body 1, a casing 26 can be fixedly secured, inside which upright tube 4.1 is disposed. Interlayer I 13 is arranged between casing 26 and stove body 1, which connects to ambient air with vent I 15. Interlayer II 14 is arranged between casing 26 and upright tube 4.1, which connects to ambient air with vent II 16. By setting up interlayer I 13 and interlayer II 14, based on air insulation, the fuels contained in upright tube 4.1 can avoid contact with stove body 1 in a long time and a close distance, which prevents the fuels inside upright tube 4.1 from overheat.

Firebox 2 can be coupled with air intake pipe 18, inside which the fourth end portion of slant tube 4.2 can be disposed. Vent III 17 can be arranged on the outside surface of casing 26, with which air intake pipe 18 connects to ambient air. The fourth end portion of slant tube 4.2 can be arranged as enclosed within air intake pipe 18, pointing in a direction along incoming air (an inward wind), therefore simultaneously raises combustion efficiency and unblocks the fuel feeding.

The cross section of firebox 2 has a circular shape, which can permit the fire inside firebox 2 to spiral easily, therefore the fuels can burn more thoroughly and the combustion efficiency can be improved.

Stove body 1 has an exhaust 27 that connects to chimney 20, in which the connection between chimney 20 and exhaust 27 is fixed but detachable. The length of chimney 20 is adjustable, which disposes at its upper portion a vent IV 21 that fits in a spark arrestor, and installs at its top a dish-shaped chimney cap (heat reflector) 22. Due to the chimney effect, chimney 20 can provide natural draft that creates a pressure difference between firebox 2 and ambient air, which supports combustion by the incoming air. Vent IV 21 disposed at the upper portion of chimney 20 can dissipate heat, and the spark arrestor fitted therein can prevent emissions of sparks. Chimney cap (heat reflector) 22 can be in a shape of dish, curving downwards, which provides an aesthetical appearance, and converges uprising heat from firebox 2 then conduct heated air to a lower position, by which the heated air can diffuse around areas surrounding the stove body below the chimney cap (heat reflector) to improve warming effect.

Firebox 2 can have grate 5 inside, in which grate 5 is disposed lower than the connection between feed tubes 4 and firebox 2. With such implementation, the fuels above grate 5 can burn into ashes that can later fall under grate 5, by which the height of the fuels above grate 5 can be lowered, further causing the fuels contained inside hoppers 3 to drop, under gravity, onto grate 5 via feed tubes 4, thus realizing automatic control of feeding the fuels from hoppers 3 into firebox 2. Within stove body 1, a grate support ring 6 is installed, upon which grate 5 can be placed. Ash tray 8 is arranged under grate 5. Ashes resulted from combustion of the fuels can fall from grate 5 onto ash tray 8. Grate lever 7 can fixedly join grate 5, penetrate and extend outside stove body 1. With such implementation, by shaking grate lever 7, the fire can be controlled, and the ashes can fall below grate 5 in a convenient way. On a front portion of stove body 1, viewport 11 is installed, the material of which is heat-resisting glass, and vent V 23 is also installed, in which both viewport 11 and vent V 23 can be both installed on stove body door 10. With such implementation, the fire can be conveniently watched through viewport 11 installed on stove body 1. Vent V 23, as arranged, can make the burning fire spiral, and provide convenient means for using a tool to poke the ashes, making them fall from grate 5 onto ash tray 8. At a bottom portion of stove body 1, legs 19 with adjustable height are installed, which can be conveniently adjusted to set a height for stove body 1.

Vent VI 25 can be arranged at the fourth end portion of slant tube 4.2, which can be set to facilitate the fuels to fall into firebox 2 from slant tube 4.2.

In some implementations, for at least one of hoppers 3, the stove disclosed herein can further include a control lever 28 for controlling the feeding of the pellet fuels, such as wood pellets. Control lever 28 is a straight, thin shaft, with a handle (e.g., a ball-shape handle) at a fifth end portion of control 28 lever and a fork with a plurality of tines at a sixth end portion of control lever 28. Control lever 28 can be disposed in the gap between hopper 3 and stove body 1, along an upright direction as upright tube 4.1, with the ball-shaped handle at top and the fork at bottom. For example, control lever 28 can be disposed within interlayer I 13 or interlayer II 14. In some implementations, the length of the shaft can be arranged so that the handle can be entirely enclosed within hopper 3 and hopper cover 12. The shaft of control lever 28 penetrates ring 29 fixed on stove body 1, through which the shaft can freely move up and down. The fork is so disposed that, when the shaft moves up and down, the fork can move respectively out of and into an intersection portion of feed tube 4 along a transverse direction of feed tube 4, in which the intersection can define holes or channels corresponding to the plurality of tines of the fork to move through. In some implementations, the intersection portion can be around the joint of upright tube 4.1 and slant tube 4.2. In some implementations, the intersection portion can be a downstream position with respect to the joint. With such implementation, when control lever 28 is fully pushed down by using the handle, the fork moves into feed tube 4 and fully blocks the feed tube, such as acting as a gate, preventing the pellet fuels from entering stove body 1, by which the fire inside firebox 2 can burn out in a relatively short time due to lack of supplemental fuels.

All references, including publications, patent applications, and patents, cited herein are hereby incorporated by reference to the same extent as if each reference were individually and specifically indicated as incorporated by reference and were set forth in its entirety herein.

The above-described aspects have been described in order to allow easy understanding of the present disclosure and do not limit the present disclosure. Characteristics not described in above aspects can be implemented or adopted by existing techniques, which will not be further discussed hereinafter. The disclosure is intend portioned to cover various variations, modifications, additions, replacements, and equivalent arrangements included within the scope of the append portioned claims, which scope is to be accorded the broadest interpretation so as to encompass all such modifications and equivalent structure as is permitted under the law.

What is claimed is:

1. A stove, using biomass pellets as fuels, comprising:

a stove body, wherein the stove body comprises a firebox having upper and lower portions;

a hopper configured to store the fuels;

a casing fixedly joining the stove body;

a feed tube having an upright tube extending alongside and adjacent to an upper portion of the firebox and a slanted tube extending from the upright tube to the firebox, wherein the upright tube is connected to store a portion of the fuels while the stove is in an operational state, wherein the hopper is connected to the firebox via the feed tube, wherein the casing surrounds at least one of the upright tube or the slanted tube, wherein the fuels contained inside the hopper are gravity fed to the firebox, and wherein a point where the fuels enter the firebox from the feed tube is closer to the lower portion of the firebox than the upper portion of the firebox; and a control lever comprising a shaft and a blocking member connected to the shaft, wherein the shaft is adapted to alternatively move in a first direction and a second direction in a gap between the hopper and the stove body, wherein the blocking member moves substantially inside of the feed tube to block the fuels from entering the firebox when the shaft is moved in the first direction and the blocking member moves substantially outside of the feed tube to allow the fuels to enter the firebox when the shaft is moved in the second direction.

2. The stove of claim 1, further comprising a second feed tube connected to a second hopper and the firebox, wherein gravity moves the fuels from the second hopper into the firebox along the second feed tube.

3. The stove of claim 2, wherein a cross section of the firebox is circular, and the hopper, the second hopper, the feed tube, and the second feed tube are symmetrically arranged with respect to a centerline of the firebox.

4. The stove of claim 1, wherein a portion of the hopper is disposed directly above the stove body, and an air gap is formed between the portion of the hopper directly above the stove body and the stove body.

5. The stove of claim 4, wherein a hopper cover is on a top portion of the hopper.

6. The stove of claim 1, further comprising:

an exhaust at a top portion of the stove body;

a chimney that joins the exhaust; and a vent at an upper portion of the chimney.

7. The stove of claim 6, wherein a length of the chimney is adjustable, and further comprising:

a dish-shape chimney cap at a top portion of the chimney; and a spark arrester at the vent.

8. The stove of claim 1, further comprising:

a grate inside the firebox, wherein the grate is lower than the point where the fuels enter the firebox from the feed tube.

9. The stove of claim 8, further comprising:

a grate support ring inside the stove body, wherein the grate is disposed on the grate support ring; and a grate lever that fixedly joins the grate, penetrates the stove body, and extends outside the stove body.

10. The stove of claim 8, further comprising an ash tray under the grate.

11. The stove of claim 10, further comprising one or more legs, wherein a height of at least one of the one or more legs is adjustable.

12. The stove of claim 1, further comprising a vent at a front portion of the stove body, and a viewport on the stove body.

13. The stove of claim 1, further comprising:

a ring fixed in the gap between the hopper and the stove body, wherein the shaft is adapted to alternatively move up and down in the first direction and the second direction through the ring.

14. A stove, using biomass pellets as fuels, comprising:

a stove body having an upper portion and a lower portion;

a firebox disposed within the lower portion of the stove body, wherein the firebox has a lower portion and an upper portion;

a hopper disposed above the stove body, wherein the hopper is configured to store the fuels therein;

a feed tube having an upright tube and a slanted tube extending from the upright tube to the firebox, wherein the feed tube is configured to feed, via gravity, the fuels from the hopper to the firebox, wherein the fuels enter the firebox at a point closer to the lower portion of the firebox than the upper portion of the firebox, wherein the upright tube is configured to store a portion of the fuels while the stove is in an operational state;

a casing containing the upright tube outside of the stove body, wherein the casing and the upright tube extend alongside and adjacent to the upper portion of the firebox and the upper portion of the stove body; and a control lever comprising a shaft, a handle at a first end of the shaft, and a blocking member at a second end of the shaft, wherein the handle is disposed within the hopper and causes the shaft to alternatively move in a first direction and a second direction in a gap between the hopper and the stove body, and wherein the blocking member moves to be substantially inside of the feed tube to block the fuels from entering the firebox when the shaft is moved in the first direction and the blocking member moves to be substantially outside of the feed tube to allow the fuels to enter the firebox when the shaft is moved in the second direction.

15. A stove, using biomass pellets as fuels, comprising:

a stove body having a firebox;

a hopper configured to store the fuels;

a feed tube having an upright tube and a slanted tube, wherein the hopper is connected to the firebox via the feed tube and the fuels contained inside the hopper enter the firebox along the feed tube via gravity;

and wherein the upright tube is configured to store a portion of the fuels while the stove is in an operational state;

a casing fixedly joining the upright tube to a lateral side of the stove body, wherein the upright tube is inside the casing, and the casing and the upright tube extends alongside an upper portion of the lateral side of the stove body;

a first interlayer arranged between the casing and the upper portion of the stove body;

a first vent that connects the first interlayer to ambient air;

a second interlayer arranged between the casing and the upright tube adjacent to the upper portion of the stove body; and a second vent that connects the second interlayer to the ambient air; and a control lever comprising a shaft and a blocking member connected to the shaft, wherein the shaft is adapted to alternatively move in a first direction and a second direction in the first interlayer or the second interlayer, wherein the blocking member moves substantially inside of the feed tube to block the fuels from entering the firebox when the shaft is moved in the first direction and the blocking member moves substantially outside of the feed tube to allow the fuels to enter the firebox when the shaft is moved in the second direction.

16. The stove of claim 15, further comprising:

an air intake pipe that joins the firebox, wherein an end portion of the slanted tube is enclosed within the air intake pipe; and a third vent on the casing, wherein the air intake pipe connects to the ambient air via the third vent.

17. The stove of claim 16, further comprising a sixth vent, wherein the sixth vent is at the end portion of the slanted tube.

18. The stove of claim 7, wherein a point where the blocking member moves into the feed tube is in closer to a joint between the upright tube and the slanted tube than the point where the fuels enter the firebox from the feed tube.

* * * * *